US008747147B2

(12) United States Patent
Yu et al.

(10) Patent No.: US 8,747,147 B2
(45) Date of Patent: Jun. 10, 2014

(54) ELECTRICAL CONNECTOR WITH DETECT PINS

(71) Applicant: Hon Hai Precision Industry Co., Ltd., New Taipei (TW)

(72) Inventors: Chun-Ming Yu, Kunshan (CN); Kai-Gang Yu, Kunshan (CN); Ji-Chao Wang, Kunshan (CN); Terrance F. Little, Fullerton, CA (US); Stephen Sedio, Valley Center, CA (US); An-Jen Yang, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 28 days.

(21) Appl. No.: 13/659,936

(22) Filed: Oct. 25, 2012

(65) Prior Publication Data

US 2014/0120778 A1 May 1, 2014

(51) Int. Cl.
*H01R 3/00* (2006.01)

(52) U.S. Cl.
USPC ..... 439/489; 439/108

(58) Field of Classification Search
USPC ..... 439/489, 660, 108
See application file for complete search history.

(56) References Cited

U.S. PATENT DOCUMENTS

| | | | | |
|---|---|---|---|---|
| 6,050,858 | A * | 4/2000 | Liu et al. | 439/660 |
| 7,367,844 | B2 * | 5/2008 | Xu | 439/630 |
| 7,625,243 | B2 | 12/2009 | Chen et al. | |
| 8,206,174 | B2 * | 6/2012 | Ko | 439/489 |
| 8,475,202 | B1 * | 7/2013 | Chiang | 439/489 |
| 2008/0132110 | A1 * | 6/2008 | Lai et al. | 439/489 |
| 2010/0279552 | A1 * | 11/2010 | Zhu et al. | 439/630 |
| 2012/0322282 | A1 * | 12/2012 | Naito et al. | 439/137 |
| 2013/0316592 | A1 * | 11/2013 | YU et al. | 439/660 |

FOREIGN PATENT DOCUMENTS

CN 202076609 12/2011

* cited by examiner

*Primary Examiner* — James Harvey
(74) *Attorney, Agent, or Firm* — Wei Te Chung; Ming Chieh Chang

(57) ABSTRACT

An electrical connector comprises an insulative housing, a metallic shell surround the insulative housing, a plurality of contacts and two detect pin retained to the insulative housing. The insulative housing is formed with a base and a tongue extending forwardly from the base. The shell and the insulative housing define a receiving cavity therebetween. The two detect pins are fastened to two opposite ends of the insulative housing, respectively, each has a detecting portion located in the receiving cavity, and the detecting portions of the two detect pins are disposed offset along a front-to-back direction for being selectively pushed by the mating plug. One of the contacts is formed with a wing contacting with the first detecting portion. The electrical connector can detect insertions of different mating plugs via the detect pins.

17 Claims, 7 Drawing Sheets

ELECTRICAL CONNECTOR WITH DETECT PINS

BACKGROUND OF THE INVENTION

1. Field of the Invention

The present invention relates to an electrical connector, and more particular to an electrical connector with detect pins for indicating insertion of a mating plug therein.

2. Description of the Related Art

USB Implementers Forum, Inc, has developed Universal Serial Bus 3.0 Specification on Nov. 12, 2011, we call it as USB 3.0 specification, and a USB (Universal Serial Bus) 3.0 receptacle and a USB 3.0 plug are introduced therein. USB 3.0 has a higher transfer rate of 4.8 Gbit/s, while a transfer rate of previous USB 2.0 connectors is just 480 Mbit/s. However, someone think a new USB connector capability of delivering a big power is needed too, so USB Implementers Forum, Inc, published USB Power Deliver specification on Jul. 5, 2012, which discloses USB 3.0 PD (Power Deliver) plug and USB 3.0 PD (Power Deliver) receptacle on pages 46-50 of the specification.

The USB PD 3.0 receptacle adds a pair of insertion detect pins, pins. 12-13, and two PD detect pins, pins 10-11 relative to USB 3.0 receptacle. The insertion detect pins, pins 12-13 are closed to an insertion port of a receiving space the USB PD 3.0 receptacle, and pin 13 is located under the pin 12, when a USB plug, including USB 2.0 plug, USB 3.0 plug, USB PD 3.0 plug, and thin card, inserts into the USB PD 3.0 receptacle, the pin 12 is downwardly pressed by the USB plug and contacts with the pin 13, so an insertion detect circuit is turned on. The PD detect pins, pins 10-11, are disposed near the end of the receiving space, away from the port.

USB PD 3.0 plug is specially designed, a shell thereof is extending beyond a free end of a tongue of the insulative housing, so a length of a front part of the USB PD 3.0 plug in front of a blocking wall is about 10.05 mm, the front part can be completely received in USB PD 3.0 receptacle and USB 3.0 receptacle. While the length of a corresponding front part of USB 2.0 plug and USB 3.0 plug is 8.65 mm.

For the USB PD 3.0 receptacle, when USB 2.0 plug or USB 3.0 plug is inserted, since the corresponding front part is not long enough, the PD detect pin will not be touched; when USB 3.0 PD plug is inserted, since the front part of USB 3.0 PD plug can arrive the end of the receiving space of the USB PD 3.0 receptacle, the PD detect pin will touch the shell of the USB 3.0 PD plug and turn on the PD detect circuit; the final situation is the thin card inserted, however, a corresponding front part of the thin card is an plastic part, can not turn on the circuit. So, only USB 3.0 PD plug can conduct the PD detect pins of USB 3.0 PD receptacle, and then a big power transmission will be put between USB 3.0 PD plug and USB 3.0 PD receptacle.

However, the arrangement of the insertion detect pins and the PD detect pin are complex, an improved connector is needed.

SUMMARY OF THE INVENTION

Accordingly, an object of the present invention is to provide an electrical connector having a detect pin.

In order to achieve the object set forth, an electrical connector comprises An electrical connector comprises an insulative housing, a metallic shell, a plurality of contacts mounted to the insulative housing and a first and a second detect pins. The insulative housing is formed with a base and a tongue extending forwardly from the base. The metallic shell covers the insulative housing thereby defining a receiving cavity surrounding the tongue for receiving a mating plug and defining an insertion direction. The first and thea second detect pins are fastened to two opposite ends of the base, respectively, each of the first and the second detect pins forwardly protrudes and hays a detecting portion located in the receiving cavity. The detecting portions of the first and the second detect pins disposed are offset along the insertion direction for being selectively pushed by the mating plug.

Other objects, advantages and novel features of the invention will become more apparent from the following detailed description of the present embodiment when taken in conjunction with the accompanying drawings.

DETAILED DESCRIPTION OF THE INVENTION

Figure 1:
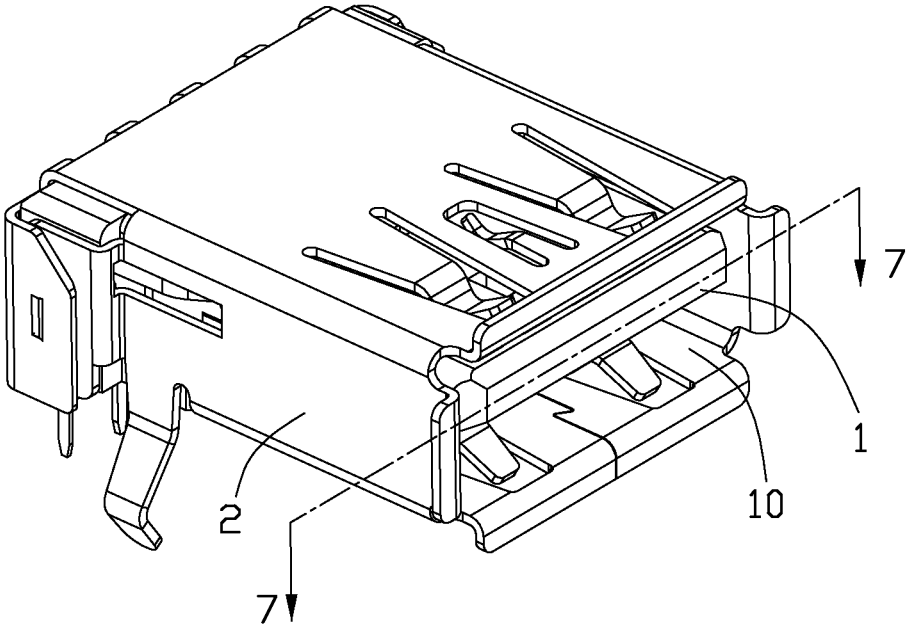
FIG. 1 is an assembled, perspective view of an electrical connector in accordance with the present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
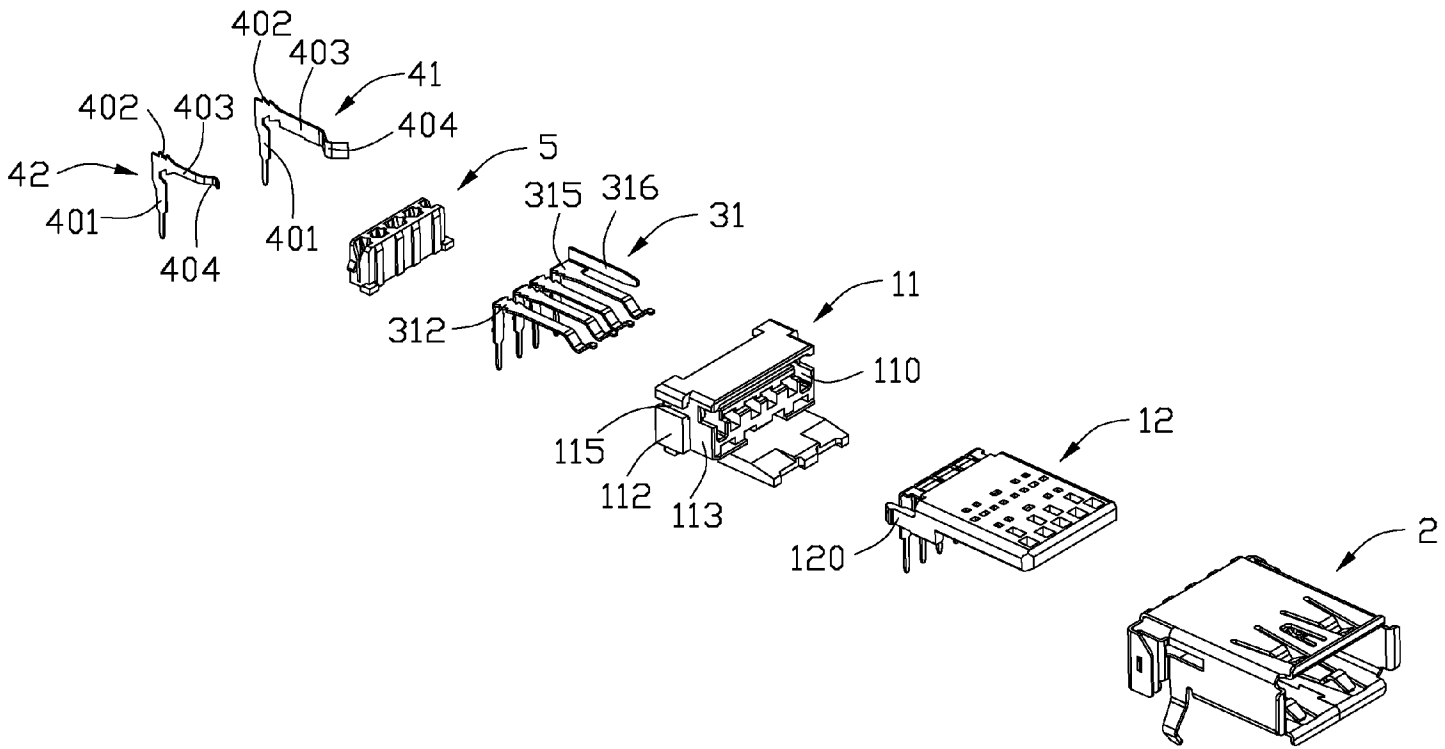
FIG. 2 is an exploded perspective view of the electrical connector shown in FIG. 1.

Referring to FIG. 1 to FIG. 2, an electrical connector in accordance with an embodiment of the present invention is provided and configured as a USB 3.0 PD receptacle, it should be pointed out that the other similar electrical connectors, such as USB 2.0 connector, eSATA connector, Display Port connector and et al, are also suitable for incorporation of the present invention. The electrical connector has a substantial same configuration as that of USB 3.0 receptacle except further having detect pin. A conventional USB 3.0 receptacle are described in detail in many patents, such as U.S. Pat. No. 7,625,243, the disclosure of which are incorporated herein by reference to the extent not inconsistent herewith.

The electrical connector comprising an insulative housing 1, and a metallic shell 1 surrounding the insulative housing 1 and defining a receiving cavity 10 cooperatively with the insulative housing 1. A plurality of conductive contacts and two detect pins retained to the insulative housing 1 and exposed in the receiving cavity 10. The receiving cavity 10 defines an insertion direction along a front-to-back direction.

Figure 3:
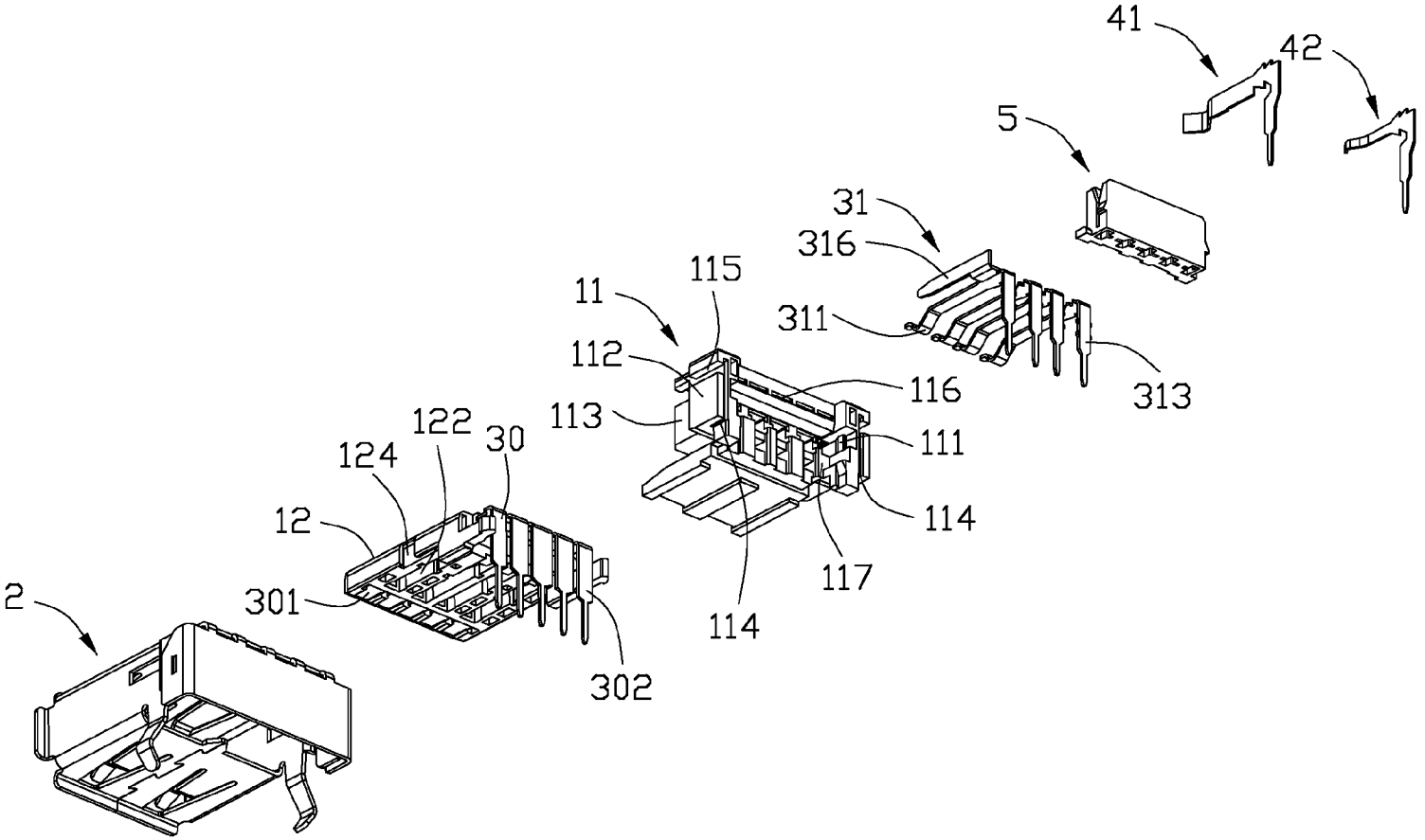
FIG. 3 is an assembled, perspective view of the electrical connector without a shell thereof.
Figure 4:
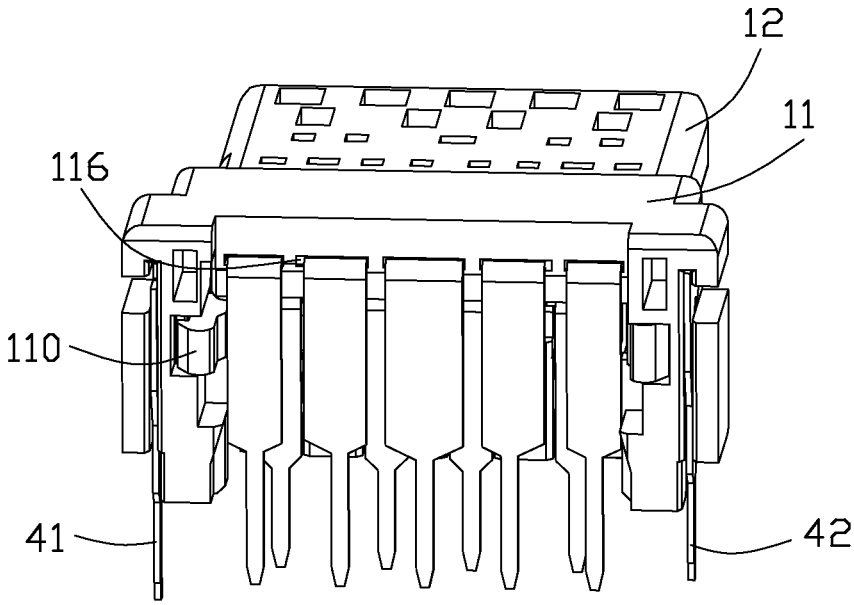
FIG. 4 is another exploded, perspective view of the electrical connector shown in FIG. 1 from another side.
Figure 5:
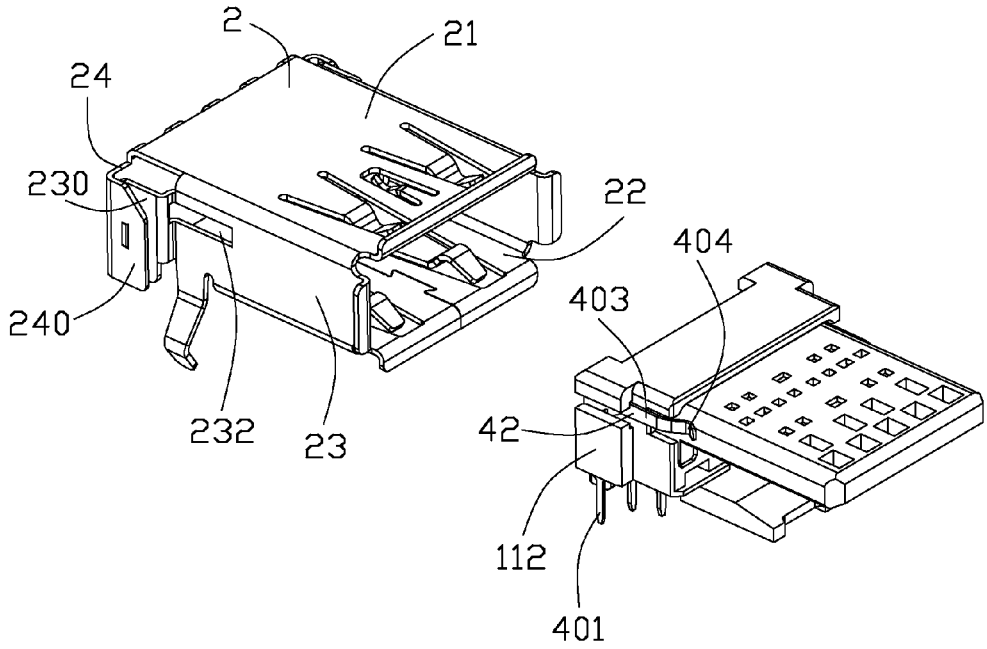
FIG. 5 is another perspective view of the electrical connector shown in FIG. 1, wherein a metallic shell there of is removed from an insulative housing thereof.
Figure 6:
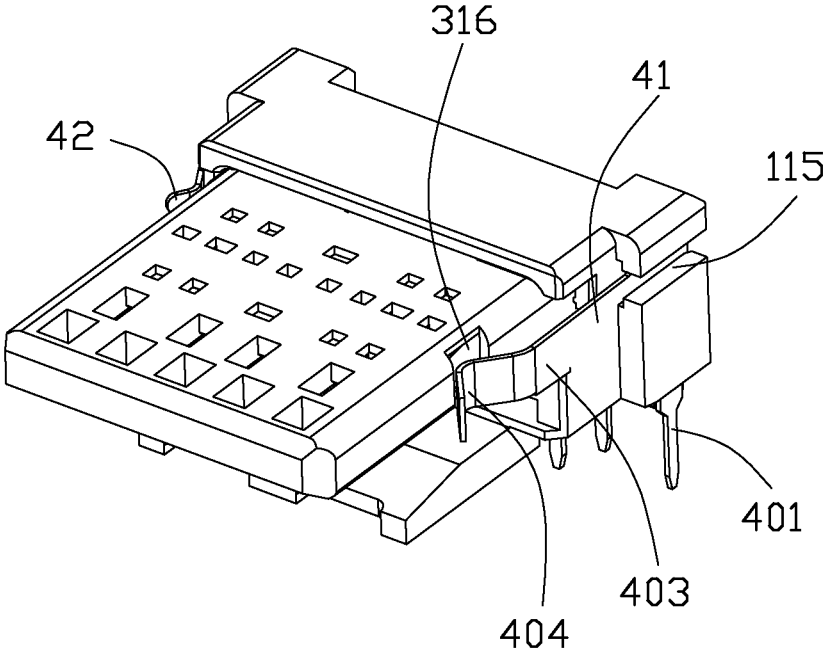
FIG. 6 is similar with FIG. 4, while taken from another side.
Figure 7:
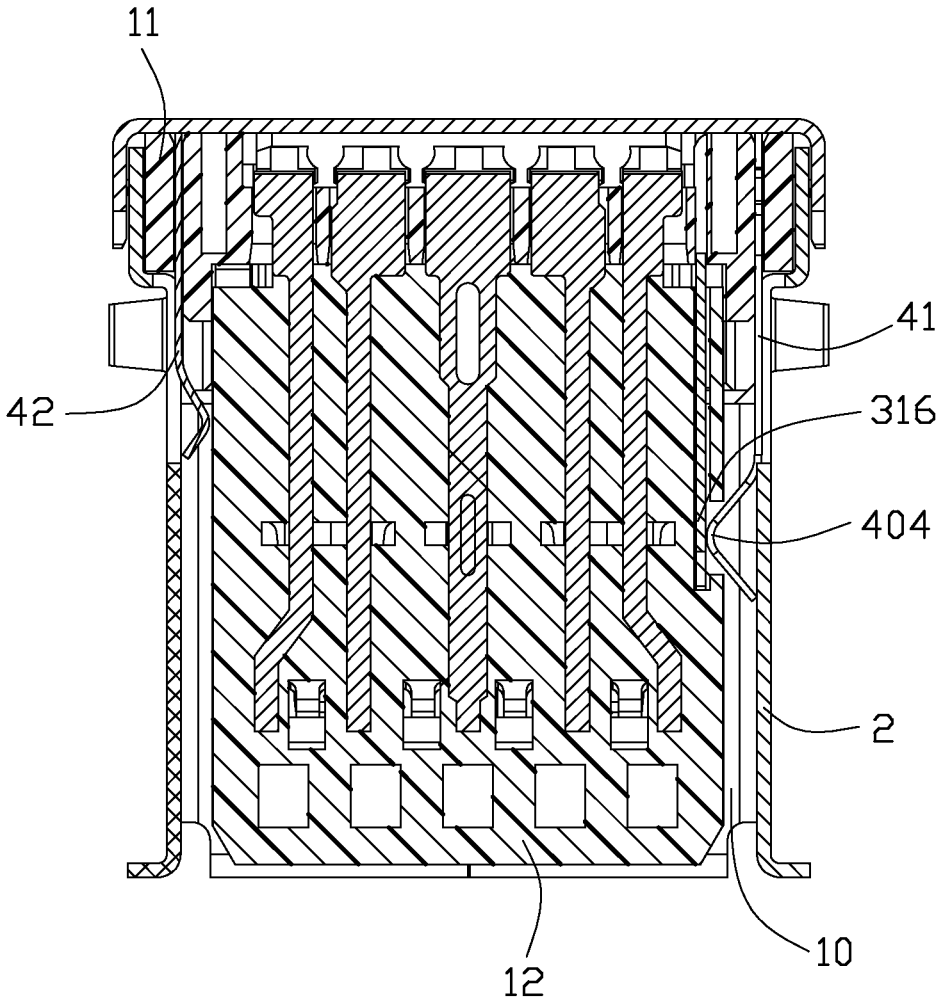
FIG. 7 is a cross sectional view of the electrical connector, along line 7-7 in FIG. 1.

FIGS. 2-3 illustrate exploded configuration of the electrical connector in present embodiment, the insulative housing 1 comprises a base 11 and a tongue 12 assembled to the base 11 and extending forwardly from the base 11, in alternative embodiment, the base 11 and the tongue 12 also may be integrated. The conductive contacts consist of nine pins, five first contacts 30 and four second contacts 31, which are jointly compliance to USB 3.0 standard.

The base 11 defines a groove 110 therethrough along a front-to-back direction, the tongue 12 is inserted into the groove 110 from the front-to-back, two latching arms 120 extend rearward from a rear end of the tongue 12 and lock with bumps 111 formed on an inner wall of the groove 110 to retain the tongue 12 to the base 11.

The first contacts 30 are insert-molded with the tongue 12 and each have a planar first contacting portion 301 arranged in a front row near a port of the receiving cavity 10. Each of the first contacts 30 has a tail portion 302 bent downwardly to be soldered to a printed circuit board. The second contacts 31 are assembled to the base 11 and extend forwardly toward the tongue 12. Each second contact 31 has an arched second contacting portion 311 floatablely received in slots 122 defined in the tongue 12 and arranged in a rear row on the tongue 12 behind the front row of the first contacting portions 301. Each of the second contacts 31 has a retaining portion 312 interfering with the base 10 and a tail portion 313 bent downwardly from the retaining portion 312 to be soldered to the printed circuit board. The tail portions 313 are initially kept in horizontal plane, then pass through a plurality of passageways 116 defined on the base 11 when the tongue 12 is assembled to the base 11, and finally are bent downwardly.

The base 11 has two flanges 112 projecting from two lateral side walls 113 thereof. A vertical retaining slot 114 is defined between each flange 112 and corresponding lateral side walls 113. The detect pins are mounted in the retaining slots 114, respectively. The retaining slot 114 passes through the base 11 along the front-to-back direction and also through the base 11 downwardly so that the detect pin can extend forwardly into the receiving cavity 10 and downwardly to mount to the printed circuit board. The flange 112 further has a notch 115, the notch 115 penetrates the flange 112 along the front-to-back direction and outwardly to communicate with exterior and inwardly to communicate with retaining slot 114 so as to allow a part of detect pin outside the retaining slot 114 to pass the flange 112.

Conjoined with FIGS. 4-7, the detect pin includes a first detect pin 41 and a second detect pin 42, the first and the second detect pins 41, 42 substantially have a vertical piece-shape and are forwardly inserted into the corresponding retaining slots 114, respectively, to be positioned on two lateral sides of the receiving cavity 10 and be limited by the retaining slots 114 to move forwardly and vertically. Both the first and the second detect pins 41, 42 are formed in an L-shaped, each detect pin has a vertical leg 401, a mounting part 402 horizontally and forwardly extending from a top end of the leg 401, an elastic arm 403 further forwardly extending from the mounting part 403 and a detecting portion 404 on a front of the elastic arm 403. The vertical leg 401, the mounting part 402 and the elastic arm 403 are located in a same plane, and the detecting portion 404 is an arched shape and project inwardly toward a center of the receiving cavity 10. There are some differences between the first and the second detect pins 41, 42, related description is in another paragraph below.

The mounting part 402 is fastened in the retaining slot 114 by barbs formed on a top and a bottom edges thereof interfering with the retaining slot 114; the vertical leg 401 extends downwardly from the retaining slot 114 for mounting to the printed circuit board; the elastic arm 403 with the detecting portion 404 pass through the notch 115 and stretch forwardly beside the receiving cavity 10, the detecting portion 404 is exposed in the receiving cavity 10.

Referring to FIGS. 2-3, the four second contacts 31 include a grounding pin 315 disposed on an end of the second row near the first detect pin 41. The grounding pin 33 is formed with an upright wing 316 vertically and upwardly bent from an outer lateral side of the retaining portion 312. The wing 316 is embedded within the tongue 12, but a recess 124 is defined on a lateral ledge of the tongue to expose a part of the wing 316, conjoined with FIGS. 6-7, the detecting portion 404 of the first detect pin 41 protrudes into the recess 124 and contacts with the exposed part of the wing 316. That means the wing 316 and the detecting portion 404 keep contacting at an initial position and can be regarded as a detect switch. In alternative embodiment, the wing 316 may not be integrated with the grounding pin 315, and the wing can be a separated element which electrically connects with the grounding pin 315 or directly mounts to the printed circuit board.

Referring to FIGS. 2-3, the metallic shell 2 is made by stamping of a metal sheet and is configured with a top wall 21, a bottom wall 22, two opposite side walls 23, and a rear wall 24. The metallic shell 2 surrounds the insulative housing 1 and defines the receiving cavity 10 therein for receiving the USB plug therein. The side wall 23 is formed with a bending piece 230 bent outwardly and then extending rearward to cover the flange 112 of the base 11. The rear wall 24 comprises two locking pieces 240 overlapping on the bending pieces 230, respectively, to lock with the side walls 23. The elastic arms 403 of the first detect pin 41 and the second detect pin 42 are substantially coplanar with the side walls 23, respectively. The side wall 23 near the second detect pin 42 defines an opening for allowing the elastic arms 403 to outwardly deflect.

The base 11 defines a room 117 on a rear end thereof, a spacer 5 is received in the room 117 and be fastened to the base. The tail portions 313 of the second contacts 31 pass through holes of the spacer 5, the tail portions 313 of the first contacts 31 are positioned between the base 11 and the space 5.

This paragraph will give more details about the first and the second detect pins and how they work in the electrical connector. The first detect pin 41 is used as an insertion detect pin, and the second detect pin 42 is used as a PD detect pin, so the elastic arm 403 of the first detect pin 41 is longer than the elastic arm 403 of the second detect pin 42, so that a detecting pin 404 of the first detect pin 41 is near a front end of the receiving cavity 10 rather than the second detect pin 42, which is closed to a rear end of the receiving cavity 10. By such arrangement, any USB Plug, including thin card, can touch the first detect pin 41 and push the first detect pin 41 outwardly to leave from the wing 316, then a status of corresponding detect circuit (not shown, may be designed in the printed circuit board) shifts from "close" to "open", to indicate an USB Plug is inserted, a power supply may begin.

Furthermore, the detecting portion of the second detect pin 42 has a smaller dimension along a vertical direction rather than that of the first detect pin 41, and the detecting portion 404 of the second detect pin 42 is controlled not to downwardly beyond the tongue 12. The thin card will not touch the detect portion 404 of the second detect pin 42 for the thin card is completely located under the tongue 12. So that only a USB PD plug whose inserted front part is long enough can touch the detect portion 404 of the second detect pin 42. Via a shell of the USB PD plug, the first detect pin 41 and the second detect pin 42 electrically conduct with each other, then, a status of corresponding detect circuit (not shown, may be designed in the printed circuit board) shifts from "open" to "close", to indicate an USB PD Plug is inserted, a big power supply may begin. The other USB plugs will not touch or push the second detect pin 42, and the corresponding detect circuit keep "open". In this embodiment, the first detect pin 41 and the second detect pin 42 form another detecting switch, in another embodiment, maybe the first detect pin 41 and the metallic shell 2 form the another detecting switch by directly contacting or indirectly electrically contact via the shell of the plug.

The electrical connector has a simple configuration and can provide two-step detecting, not only detecting if a plug is inserted but also detecting if a certain plug is inserted. The detect pins 41, 42 are retained to projecting flanges 112 of a rear end of the insulative housing 1 and coplanar with side walls 23 of the metallic shell 2, the receiving space 10 need not to provide additional space for the detect pin 41, 42 and still keep a standard inserting port. The wing 316 contacting with the first detect pin 41 is set within the tongue, that also simply the configuration of the electrical connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing formed with a base and a tongue extending forwardly from the base;

a metallic shell covering the insulative housing thereby defining a receiving cavity surrounding the tongue for receiving a mating plug and defining an insertion direction;

a plurality of contacts mounted to the insulative housing; and a first and a second detect pins fastened to two different positions of the base, respectively, each of the first and the second detect pins forwardly protruding and having a detecting portion located in the receiving cavity, the detecting portions of the first and the second detect pins disposed offset along the insertion direction for being selectively pushed by the mating plug; wherein the contacts include five first contacts and four second contacts, each first contact has a flat contacting portion, each second contact has an elastic contacting portion, the flat contacting portions are exposed on a face of the tongue and in a front row, the elastic contacting portions are exposed on the same face of the tongue and in a rear row; wherein the second contact has a grounding contact formed with an upright wing, a part of the wing is exposed and contacts with the detecting portion of the second contact while disconnects with the detecting portion of the second contact when a plug is inserted in the receiving space.

2. The electrical connector as described in claim 1, wherein the first detect pin and the second detect pin are respectively located around two opposite ends of the housing so as to have the tongue disposed between the first and the second detect pins along a transverse direction perpendicular to both the insertion direction and a thickness direction of the tongue.

3. The electrical connector as described in claim 2, wherein the base has two side walls, each side wall is formed with a flange protruding from the side wall, a vertical retaining slot is defined between the side wall and the flange to retain the detect pin.

4. The electrical connector as described in claim 3, wherein the retaining slot passes through the base along the front-to-back direction and also through the base downwardly, the detect pin is forwardly assembled to the base and is limited by the retaining slot to move forwardly and vertically.

5. The electrical connector as described in claim 4, wherein the flange further has a notch, the notch penetrates the flange along the front-to-back direction and outwardly to communicate with exterior and inwardly to communicate with the retaining slot so as to allow the detecting portion to pass through the flange.

6. The electrical connector as described in claim 4, wherein the first and the second detect pins substantially have a vertical piece-shape, each detect pin has a vertical leg, a mounting part horizontally and forwardly extending from a top end of the leg and an elastic arm further forwardly extending from the mounting part, the detecting portion is formed on a front of the elastic arm.

7. The electrical connector as described in claim 6, wherein the vertical leg, the mounting part and the elastic arm are located in a same plane, and the detecting portion is an arched shape and projects inwardly toward the tongue, the elastic arm is substantially aligned with a side wall of the shell, which defines a side of the receiving space.

8. An electrical connector for use with a plug, comprising:

an insulative housing defining a mating tongue extending forwardly in a front-to-back direction;

a plurality of contacts disposed in the housing with contacting sections exposed upon the mating tongue;

a metallic shell attached to the housing and enclosing the mating tongue circumferentially; and a first detect pin and a second detect pin located at two different positions of the housing by two opposite sides of the mating tongue and electrically isolated from the metallic shell when no plug is mated therewith; wherein the first detect pin and the second detect pin are located in a path of insertion of the plug and adapted to be electrically connected with each other by a metallic shield of the plug during mating which is adapted to be inserted into the metallic shell and mechanically and electrically contact not only both said first detect pin and said second detect pin and but also the metallic shell; wherein the first detect pin and the second detect pin are offset from each other in the front-to-back direction so that a longer plug is adapted to electrically connect said first detect pin and said second detect pin while a shorter plug is not.

9. The electrical connector as claimed in claim 8, wherein both said first detect pin and said second detect pin are located around the metallic shell and adapted to inwardly contact an exterior surface of the metallic shield of the plug during mating.

10. An electrical connector for use with a plug, comprising:

an insulative housing, the insulative housing formed with a base and a tongue stretching forwardly from the base;

a plurality of contacts received in the insulative housing, each contact formed with a contacting portion exposed on the tongue, and the contacts including a grounding contact with a wing integrated with the grounding contact and at least partially exposed on the tongue; and a first detect pin retained to an end of the base adjacent to the tongue, the first detect pin having an elastic arm forwardly extending and a detecting portion disposed around a front end of the elastic arm, the detecting portion projecting toward the tongue and contacting with the wing whereby insertion of a plug for mating results in electrical separation of the first detect pin and the grounding contact and an open status of a circuit therebetween.

11. The electrical connector as described in claim 10, wherein said wing is bent from the grounding contact in a vertical direction to confront the first detect portion of the first detect pin.

12. The electrical connector as described in claim 11, wherein the tongue defines a recess recessed from a lateral side thereof, the wing is exposed in the recess, the detecting portion of the first detect pin projects into the recess.

13. The electrical connector as described in claim 12, wherein the flange further has a notch, the notch penetrates the flange along the front-to-back direction and outwardly to communicate with exterior and inwardly to communicate with retaining slot, and the detecting portion is an arched shape and passes through the flange by the notch.

14. The electrical connector as described in claim 12, further comprising a shell surrounding the insulative housing and defining a receiving space encircling the tongue, the elastic arm is substantially located outside the receiving space and aligned with a side wall of the shell.

15. The electrical connector as described in claim 11, wherein the base has two side walls, each side wall is formed with a flange protruding from the side wall, a vertical retaining slot is defined between the side wall and the flange to retain the detect pin, the second detect pins has a mounting part retained in the retaining slot, a vertical leg downwardly extending from the mounting part and the elastic arm further forwardly extending from the mounting part, the vertical leg, the mounting part and the elastic arm are located in a same vertical plane.

16. The electrical connector as described in claim 15, further comprising a second detect pin which is retained to an opposite end of the base, the second detect pin has a substantially same configuration with the first detect pin except a shorter elastic arm.

17. The electrical connector as claimed in claim 8, wherein one of said contacts defines a wing constantly contacting one of the first and second detect pins when no plug is inserted into the metallic shell while being separated from said one of the first and second detect pins when the plug is inserted into the metallic shell.

* * * * *